US011795642B1

(12) United States Patent
Weihl

(10) Patent No.: US 11,795,642 B1
(45) Date of Patent: Oct. 24, 2023

(54) PLOW ASSEMBLY

(71) Applicant: Ricky A. Weihl, Muskegon, MI (US)

(72) Inventor: Ricky A. Weihl, Muskegon, MI (US)

( * ) Notice: Subject to any disclaimer, the term of this patent is extended or adjusted under 35 U.S.C. 154(b) by 0 days.

(21) Appl. No.: 17/940,387

(22) Filed: Sep. 8, 2022

(51) Int. Cl.
*E01H 5/06* (2006.01)

(52) U.S. Cl.
CPC ..... *E01H 5/061* (2013.01)

(58) Field of Classification Search
CPC ..... E01H 5/061; E01H 5/065; E01H 5/066
See application file for complete search history.

(56) References Cited

U.S. PATENT DOCUMENTS 3,845,870 A * 11/1974 Balderson ..... E02F 3/401 37/442
4,574,502 A * 3/1986 Blau ..... E01H 5/065 172/747
D357,483 S * 4/1995 Ramsey ..... D15/32
7,584,557 B1 * 9/2009 Nistler ..... E01H 5/065 37/234
7,712,233 B2 * 5/2010 Nesseth ..... E01C 19/203 37/409
7,762,014 B2 * 7/2010 Brock ..... E02F 3/8152 37/444
10,053,826 B1 * 8/2018 Null ..... E01H 5/067
10,508,408 B2 * 12/2019 Waters ..... E02F 3/3618
11,466,417 B2 * 10/2022 Weihl ..... E01H 5/062
2013/0067667 A1 * 3/2013 Hopkins ..... E01H 1/106 414/338
2015/0042071 A1 * 2/2015 Hamm ..... B60D 1/64 280/477
2015/0225914 A1 * 8/2015 Tykalsky ..... B60Q 1/0035 37/266
2016/0319503 A1 * 11/2016 Westman ..... B60Q 1/32
2019/0016184 A1 * 1/2019 Billich ..... A01B 69/006
2020/0114803 A1 * 4/2020 Horn ..... F21S 41/29
2022/0136193 A1 * 5/2022 Weihl ..... E01H 5/068 37/232

OTHER PUBLICATIONS

Saphir Kompakt 4001, Jan. 23, 2017, https://youtu.be/YjrxPndUniw (Year: 2017).*

* cited by examiner

*Primary Examiner* — Jamie L McGowan
(74) *Attorney, Agent, or Firm* — WARNER NORCROSS + JUDD LLP

(57) ABSTRACT

A snow plow having a wing that is rotatably coupled to a side of a primary plow, and configured to rotate about an axis relative to a side of the primary plow. The wing may include a window that allows passage of light output from the vehicle headlamps.

21 Claims, 6 Drawing Sheets

PLOW ASSEMBLY

TECHNICAL FIELD

The present application relates to a plow for a vehicle, and more particularly to a plow with a light transmissive window.

BACKGROUND

There are a variety of conventional plow constructions for vehicles. One type of conventional plow configuration is a style of plow having a main snow plow blade and wings attached to a side edge of the main snow plow blade. The conventional wings provide a larger plow face in use while being stowable for travel on the road. However, these wings as well as the main snow plow blade may interfere with the light output from the vehicle headlamps. Interference is particularly an issue during transport of the snow plow where the snow plow is raised off the ground to allow the vehicle to travel from one area to another. With the snow plow in a raised position, the snow plow is likely to block light output from the vehicle headlamps. In such cases, conventional snow plow configurations utilize supplemental lighting to allow a vehicle operator to see in low light conditions.

Conventional supplemental lighting adds both cost and complexity to the snow plow system. For instance, in an effort to simplify things for a vehicle operator, operation of the supplemental lighting is often tied to operation of the vehicle headlamps via the vehicle control system. However, different makes of vehicles may utilize different messaging control protocols for the vehicle headlamps, so the snow plow system may need to be customized for a particular vehicle make. In some cases, the messaging may be encrypted so that monitoring the vehicle control system in order to identify vehicle headlamp commands is not practical.

SUMMARY OF THE DESCRIPTION

A snow plow for a vehicle including a plow portion with first and second sides opposite each other. The plow portion may include a plow face operable to direct snow, the plow face including a lower portion and an upper portion. The plow may include a blade coupled to the plow portion, the blade operable to contact a ground surface to facilitate moving snow. The plow may include a window coupled to the upper portion of the plow face, the window being transmissive to light output from the vehicle; and a plow support operable to support the plow portion.

The foregoing and other embodiments can each optionally include one or more of the following features, alone or in combination. In particular, one embodiment includes all the following features in combination.

In some embodiments, the upper portion of the plow portion may include a window support frame that defines an aperture, and the window may be supported by the window support frame.

In some embodiments, the plow support may be removably coupled to a vehicle support.

In some embodiments, the snow plow may include an actuator operable to move the blade from a first position to a second position, where the actuator may include a compressible gas operable to bias the blade to a bias position.

In some embodiments, the blade may be disposed between the first and second sides of the plow portion.

In some embodiments, the snow plow includes a first wing that is rotatably coupled to the first side of the plow portion via a first connection. The first wing may be configured to rotate about a first axis substantially parallel to the first side of the plow portion.

In some embodiments, the snow plow may include a main plow with a first main plow side and a second main plow side. The first side of the plow portion may be rotatably coupled to the first main plow side such that the plow portion is operable to rotate about a first axis.

In some embodiments, the plow portion is a main wing portion operable to rotate about the first axis between a backward position and a forward position. The plow portion may be rotatable to an intermediate position between the backward position and the forward position.

In some embodiments, with the plow portion positioned in the backward position, the window coupled to the upper portion of the plow portion may provide transmissibility for light output from the vehicle and directed transverse with respect to a longitudinal axis of the vehicle.

In some embodiments, the intermediate position may correspond to the plow face being substantially transverse with respect to a longitudinal axis of the vehicle. The plow face may extend outward relative to a plane defined by a side of the vehicle. The window coupled to the upper portion of the plow portion may provide transmissibility for light generated from the vehicle and traveling outward relative to the plane defined by the side of the vehicle.

In some embodiments, a second wing may be rotatably coupled to the second side of the plow portion via a second connection. The second wing may be configured to rotate about a second axis substantially parallel to the second side of the plow portion. The second wing may include a second plow face operable to direct snow. The second wing may also include a second lower portion and a second upper portion.

In some embodiments, the plow may include a second window coupled to the second upper portion of the second plow face, where the second window may be transmissive to light output from the vehicle.

In some embodiments, the plow support may be operable to removably connect to a vehicle-side mount of a vehicle support.

In some embodiments, the vehicle-side mount may be disposed proximal to a front of the vehicle.

In some embodiments, the blade may be attached to the plow portion

In some embodiments, the snow plow may include an actuator operable to raise and lower the plow portion.

In some embodiments, the actuator may be operable to bias the plow portion into contact with the ground surface.

In general, one innovative aspect of the subject matter described herein can be embodied in a snow plow system for a vehicle. The snow plow system may include a plow with a main plow having a first side and a second side opposite each other with a blade disposed between the first and second sides. The blade may be operable to contact a ground surface to facilitate moving snow.

The plow may include a first wing that is rotatably coupled to the first side of the main plow via a first connection. The first wing may be configured to rotate about a first axis substantially parallel to the first side of the main plow. The plow may include a first window coupled to an upper portion of the first wing, where the first window may be transmissive to light output from the vehicle.

The plow may include a second wing that is rotatably coupled to the second side of the main plow via a second connection. The second wing may be configured to rotate about a second axis substantially parallel to the second side of the main plow. The plow may include a second window coupled to an upper portion of the second wing, where the second window may be transmissive to light output from the vehicle.

The foregoing and other embodiments can each optionally include one or more of the following features, alone or in combination. In particular, one embodiment includes all the following features in combination.

In some embodiments, the first wing may include a first plow face operable to direct snow, and where the first plow face may include a first window support frame that defines a first aperture and supports the first window.

In some embodiments, the second wing may include a second plow face operable to direct snow, and where the second plow face may include a second window support frame that defines a second aperture and supports the second window.

In some embodiments, the first wing may be operable to rotate about the first axis between a backward position and a forward position, and where the first wing may be rotatable to an intermediate position between the backward position and the forward position.

In some embodiments, with the first wing positioned in the backward position, the first window coupled to the first wing may provide transmissibility for light that is output from the vehicle and that is directed transverse with respect to a longitudinal axis of the vehicle.

In some embodiments, the intermediate position corresponds to a first wing plow face being substantially transverse with respect to a longitudinal axis of the vehicle. The first wing plow face may extend outward relative to a plane defined by a side of the vehicle. The first window may provide transmissibility for light generated from the vehicle and traveling outward relative to the plane defined by the side of the vehicle.

In some embodiments, the snow plow system may include a receiver coupled to one of the vehicle or the main plow. The receiver may define an opening for a receiver interface. The receiver interface may be movable within the receiver along a longitudinal axis of the receiver, and the receiver interface may be coupled to the other of the vehicle or the main plow that is connected to the receiver. The snow pow system may include at least one actuator operable to move the receiver interface along the longitudinal axis of the receiver. The actuator may be operable to move the main plow proximally and distally with respect to the vehicle as the at least one actuator moves the receiver interface along the longitudinal axis.

These and other advantages and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION

Figure 1:
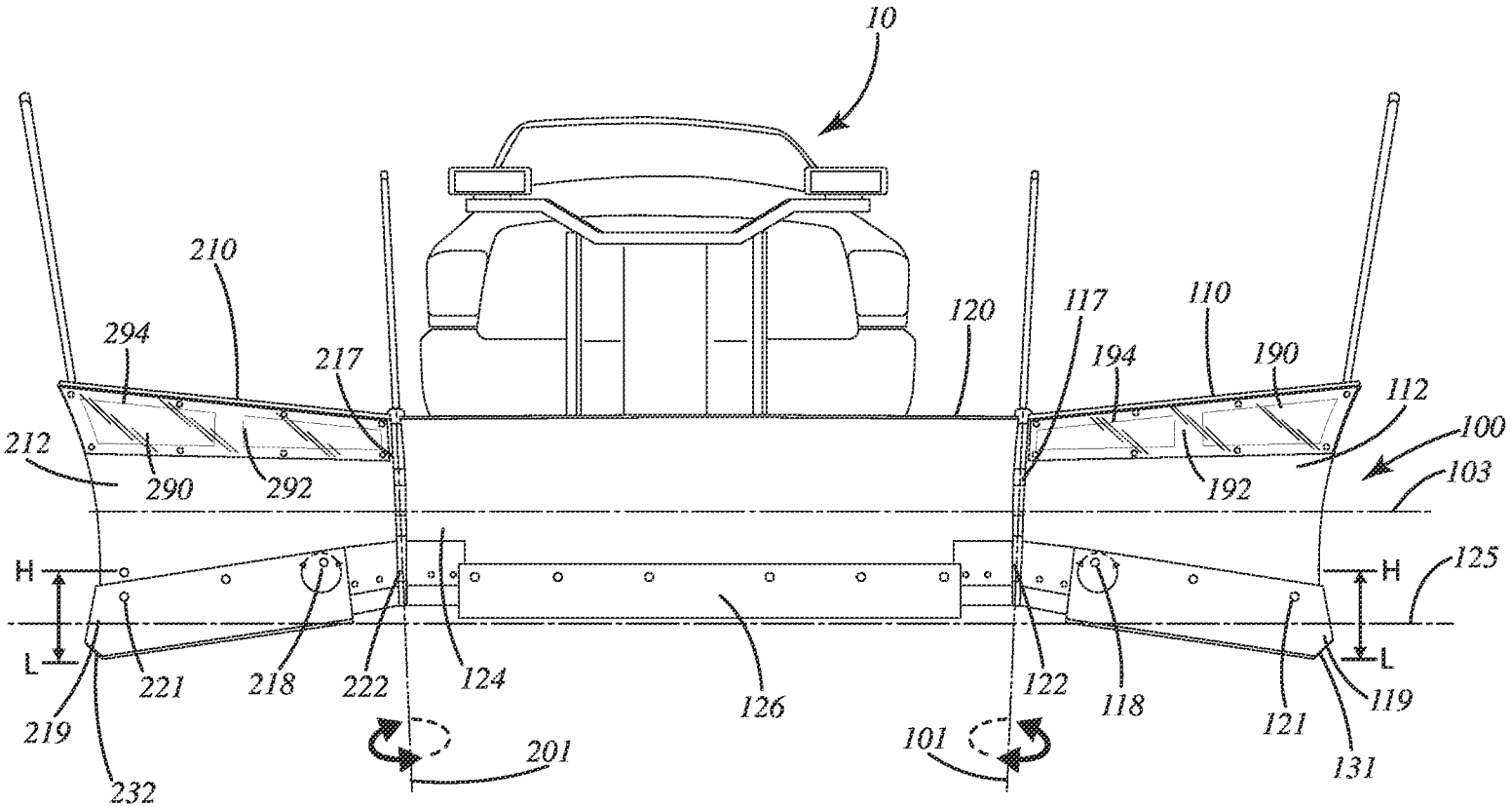
FIG. 1 depicts a snow plow in accordance with one embodiment.

A snow plow in accordance with one embodiment in the form of a front-blade plow is shown in FIGS. 1, 2, 5 and 6 and generally designated 100. The snow plow 100 may be mounted to the front of the vehicle 10 as depicted in FIG. 1, and may be coupled to a vehicle support 412 via a plow support 380. The vehicle support 412 may be removably coupled to a vehicle mount 112, which is attached to the vehicle 10. In other words, the snow plow 100 may be mounted to the front of the vehicle 10 via the vehicle supports 412 and the vehicle mounts 112.

The snow plow 100 in the illustrated embodiment may include a primary plow 120 coupled to the plow support 380. The snow plow 100 may also include a first wing 110 and a second wing 210. The first wing 110 may be rotatably coupled to the primary plow 120 on a first side 122 via a joint 117. The joint 117 may vary from application to application, and is depicted as a hinge and pin configuration but the disclosure is not so limited. The joint 117 allows the first wing 110 to rotate about an axis 101 between position F and position B as described with respect to FIG. 3. For instance, relative to a vehicle plane 14 defined by a side of the vehicle 10, the first wing 110 may be rotated between a position F and a position B both of which may be parallel to the plane 14. Additionally, the first wing 110 may be positioned between positions F and B, including a position E identified in FIG. 3 and corresponding to an extended position parallel to the longitudinal axis 2103 and substantially perpendicular to the vehicle plane 14.

Rotation about the axis 101 allows the first wing 110 to rotate toward the vehicle 10 to position B, which may allow the vehicle 10 to fit within a standard vehicle lane while travelling. The first wing 110 can also rotate away from the vehicle 10 to position F. The first wing 110 may be rotated by an actuator 114, which is described below with reference to FIG. 6.

It is to be understood that the present disclosure, although described in conjunction with a snow plow, is not limited to a snow plow configured primarily for displacing snow. For instance, the snow plow 100 in an alternative embodiment may be configured as a general plow or blade (e.g., a bulldozer blade) for primarily moving debris or objects other than snow (e.g., snow removal may be an incidental function of the general plow or blade).

Figure 3:
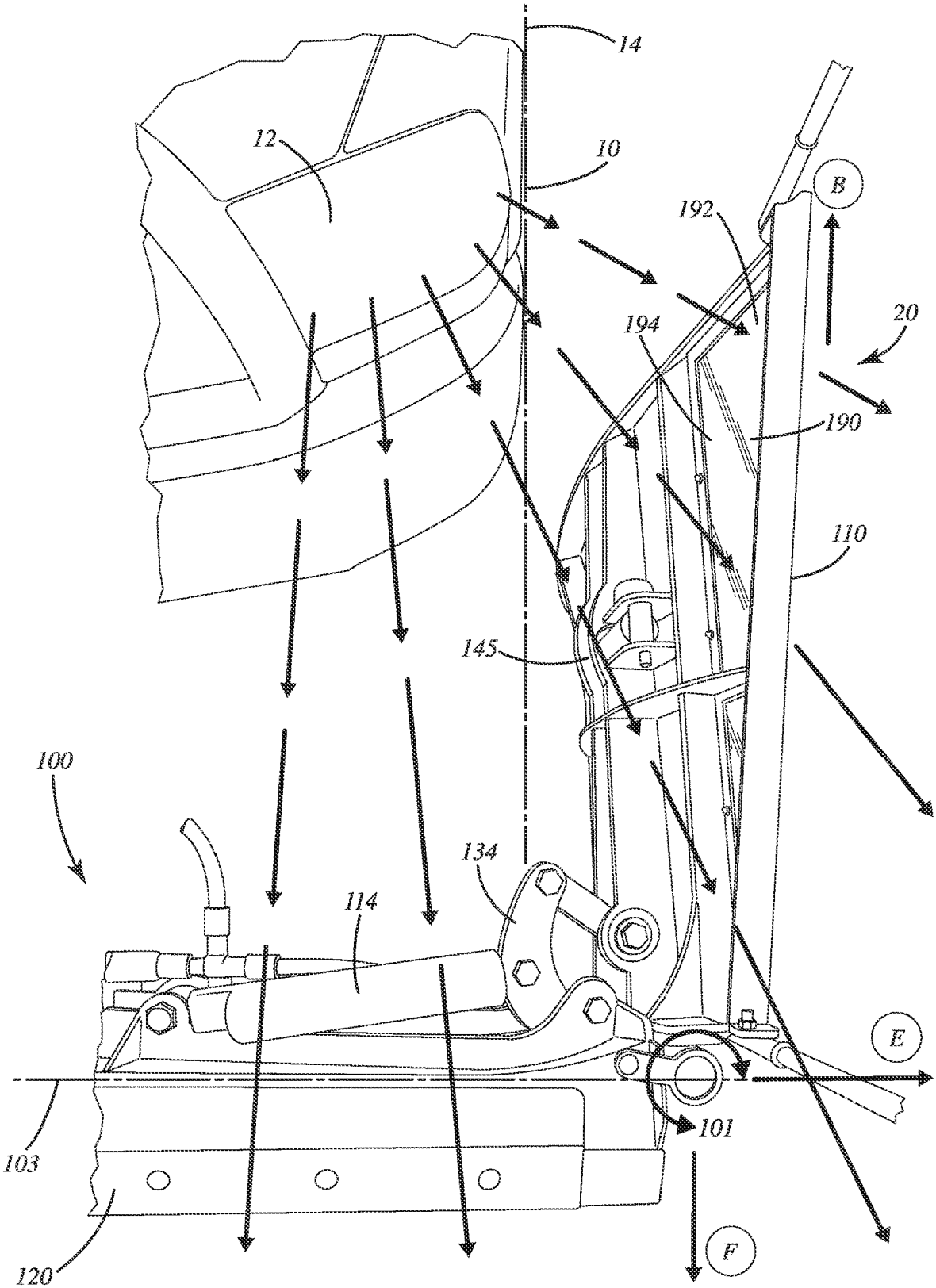
FIG. 3 shows a partial top view of the snow plow of FIG. 1.
Figure 4:
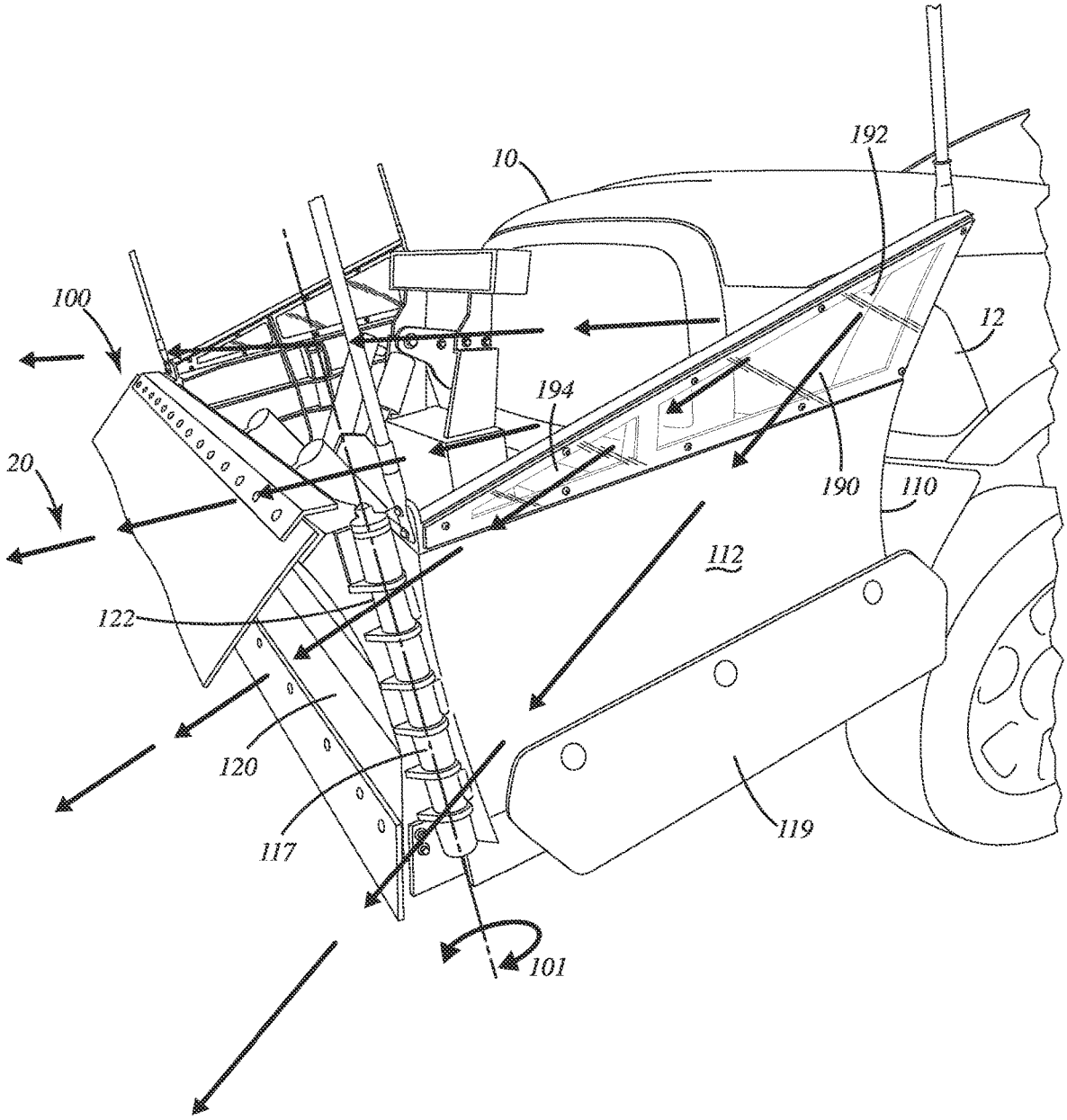
FIG. 4 shows a perspective side view of the snow plow of FIG. 1.

A wing 101 in accordance with one embodiment is depicted in FIGS. 3 and 4, including an aperture 192 and a support frame 194 operable to support a window 190. The vehicle 10 may include a head lamp 12 operable to generate and direct light 20 in front of the vehicle and to the side of the vehicle 10. The light 20 directed to the side of the vehicle 10 may intersect the vehicle plane 14 corresponding to the side of the vehicle 10. This intersection can be seen in FIG. 3.

The light 20 output from the head lamp 12 in the illustrated embodiment may pass through the window 190. In other words, the window 190 of the wing 110 may be configured to prevent the wing 110 from blocking a substantial amount of the light 20 output from the head lamp 12.

In the illustrated embodiments of FIGS. 3 and 4, a ray of light 20 is shown passing through the window 190 with the wing 110 disposed in position B. The plow 100 in the illustrated embodiments is provided in a transport mode with the plow 100 raised and the first and second wings 110, 210 disposed in position B in order to comply with lane width requirements for the vehicle 10. The first and second wings 110, 210 with the plow 100 positioned in a transport mode may partially block light 20 output from the headlamp 12 absent the window 190 provided in the first and second wings 110, 210. For instance, in the perspective side view of the snow plow 100 in the vehicle 10 in the illustrated embodiment of FIG. 4, the headlamp 12 can be seen through the window 190 of the first wing 110. Without the window 190, the first wing 110 may partially block the headlamp 12 and prevent light 20 output from the headlamp 12 toward a side of the vehicle 10. It can be seen in the illustrated embodiments that light 20 output from the headlamp toward the front of the vehicle 10 is substantially unimpeded by the snow plow 100. The snow plow 100 may be pulled in close to the front of the vehicle 10 and tilted forward to provide clearance for light 20 directed from the headlamp 12 in the front of the vehicle 10. By tilting the snow plow 100 forward, the first and second wings 110, 112 may pivot upwards relative to the ground as depicted in FIG. 4. Without the window 190, the first and second wings 110, 112 in this configuration may impede light 20 directed from the headlamp 12 to the side of the vehicle 10 through the vehicle plane 14. The window 190 in the illustrated embodiment allows the headlamp 12 to illuminate an area to the side of the vehicle 10 that may otherwise be blocked by the first and second wings 110, 112.

The window 190 in the illustrated embodiment may be formed of a light transmissive material, such as an acrylic or polycarbonate material, that is capable of being supported and mounted to a support frame 194 of the first wing 110. The support frame 194 may define an aperture or opening 192 in the first wing 110 through which light 20 may pass.

It is noted that the overall height of the first wing 2110 from the ground contacting edge to the opposite, upper edge may be reduced in order to prevent the first wing 110 from blocking light output from the headlamp 12. However, such a reduction may decrease the overall surface area of the first wing 110 for moving snow. By providing the window 190, in one embodiment, the height of the first wing 110, and overall surface area, may be increased for moving snow without blocking light output from the headlamp 12. This way, the headlamp 12 may be operable to illuminate an area in front of and to the side of the vehicle 10, in some cases, without the need for supplemental lighting to illuminate these areas. And, the window 190 may form an operable surface for moving snow.

Although several embodiments are described herein in conjunction with the first wing 110 provided at position B, it is to be understood that the first wing 110 may be positioned differently and that the window 190 may provide transmissibility with respect to light output from the headlamp 12 in any position. For instance, with the first wing 110 disposed at position E (extended), light 20 from the headlamp 12 may pass through the window 190 to illuminate an area in front of the snow plow 100.

The material construction of the window 190 may be weaker than the material that forms the main wing portion 112 of the first wing 110. For instance, the main wing portion 112 may be formed of steel that is much stronger and durable than the light transmissive material of the window 190. Because the main wing portion 112 is positioned lower toward the wing blade 119, there is likely to be greater resistance from the snow and greater force on the main wing portion 112 in comparison to the window 190. Because a majority of the first wing 110 is formed of material more durable than the light transmissive material of the window 190, the durability of the first wing 110 can be maintained despite incorporation of the lesser strength, light transmissive material.

In the illustrated embodiment of FIG. 4, the window 190 is a triangular shaped window that tapers in width from the distal side of the first wing 110 to the medial side of the first wing 110. Alternative configurations may be provided, including shapes different from a triangle such as a trapezoidal shape (including acute trapezoids, obtuse trapezoids, and parallelograms).

In the illustrated embodiments of FIGS. 1-6, the blade 126 of the primary plow 120 may be a wearable component that can be replaced as the edge of the blade 126 wears away. Example types of blades include a polymer-based blade, such as a polyurethane blade or a rubber-based blade, and a metal blade, such as heat-treated steel. The blade 126 may be attached to the mold board 124 in a fixed position such that the blade 126 is stationary. Alternatively, the blade 126 may be attached to the mold board 124 in a trippable configuration, such that the blade 126 remains generally stationary in use until an obstruction is encountered that exerts a force on the blade 126 that is greater than a threshold trip force, at which point the blade 126 may move (e.g., rotate relative to a bottom edge of the mold board 124) in order to yield to the obstruction.

The mold board 124 in the illustrated embodiment may be shaped or configured in a variety of ways, depending on the application. For instance, the mold board 124 in the illustrated embodiment of FIG. 1 provides a planar surface for pushing snow. However, the mold board 124 may be configured differently, such as having a curved surface for facilitating rolling the snow off the snow plow 100.

In one embodiment, the first wing 110 may be rotated about the first axis 101 backward and forward between positions B and F, shown in the illustrated embodiment of FIG. 3. As an example, the first wing 110 may be rotated in front of or behind the longitudinal axis 103 of the primary plow 120. Positions B and F may vary from application to application. For instance, in the illustrated embodiment, position B corresponds to a position of approximately +90° relative to the longitudinal axis 103 of the primary plow 120 shown in FIG. 1, and position F corresponds to a position of approximately −90° relative to the longitudinal axis 103 of the primary plow 120. In the illustrated embodiment, the angles for the positions F and B for the second wing 210 are similar to the angles for the positions F and B for the first wing 110, but the range of movement for the second wing 210 is opposite from the range of movement for the first wing 110.

Positions F and B correspond to the limits of movement of the first wing 110, and may vary depending on the application. It is to be understood that an operator may position the first wing 112 at a location between positions F and B in use (e.g., to plow an area or to travel). For instance, the operator may position the first wing portion 112 at an angle of 20° in use, and then move the first wing 110 to position B for travel. It is also noted that the operator may position the first wing 110 at an angle different from the position of the second wing 210. For instance, the operator may position the second wing 210 at an angle of +200° (or −160°) about the first axis 201, and position the first wing 110 at an angle of −20° about the first axis 101, thereby positioning one wing forward of the longitudinal axis 103 and the other wing aft of the longitudinal axis 103.

In one embodiment, regardless of the longitudinal axis 103 or the position and configuration of the primary plow 120, position B may correspond to an angle about the first axis 101 that disposes the first wing 110 in a stowed position such that the first wing 110 is generally proximal to and parallel to a side plane 14 of the vehicle. This way, with the first wing 110 in the stowed position, the snow plow 000 may fit within the width constraints imposed by a municipal road for travel thereon.

Components of the second wing 210 that are similar to the first wing 110 are designated with a 200 series reference number—e.g., the second wing 210 may rotate about an axis 201 in a manner similar to the first wing 110 being able to rotate about an axis 101. Accordingly, for purposes of disclosure, the descriptions of the components of the first wing 110 are not substantially duplicated to describe the corresponding components of the second wing 210.

The first wing 110 may include a main wing portion 112 and a wing blade 119. The wing blade 119 may be fixedly connected to the main wing portion 112, or the wing blade 119 may be able to rotate upwards, for example in response to a change in contour of the ground or encountering debris or an obstruction that exerts a force greater than a tripping threshold. In one embodiment, the wing blade 119 may include a pivot portion 118 and a sliding portion 121. In the depicted embodiment, the sliding portion 121 includes a fastener seated within or captured by a channel or slot to allow the wing blade 119 to move upward in response to an upward force (e.g., a tripping force or the ground in response to a change in surface contour), while maintaining a coupling between the sliding portion 121 and the main wing portion 112. The wing blade 119 may rotate about the pivot portion 118 such that the sliding portion 121 moves from position L to position H. The position L may correspond to a position lower than a ground contacting plane 125 defined by the blade 126 of the primary plow 120, and position H may correspond to a position higher than this ground contacting plane 125 defined by the wing blade 119. In use, the position of the sliding portion 121 of the wing blade 119 may be between position L and H with the wing blade 119 contacting the ground. The position of the sliding portion 121 may vary as the contour of the ground changes. As described herein, the sliding portion 121 of the wing blade 119 may be biased toward the ground such that, as the snow plow 100 travels along the ground and the ground contour lowers relative to a current position of the sliding portion 121, the sliding portion 121 may lower toward position L to follow the contour of the ground. Conversely, the sliding portion 121 may lift toward position H as the ground contour rises as the snow plow 100 travels over the ground and the height of the ground near the sliding portion 121 is different from the height of the ground near the pivot portion 118. The bias force may vary from application to application, and may be determined selectable, in operation, installation, or the design stage, or a combination thereof, to enable the sliding portion 121 of the wing blade 119 to substantially maintain contact between the wing blade 119 and the ground and to allow upward movement in response to changes in ground contour and/or an encounter with an obstruction.

In one embodiment, a distal portion 131 of the wing blade 119 distal from the pivot portion 118 may be angled (e.g., sloped or ramped) or curved, which may allow the distal portion 131 to engage a potential obstruction and cause the wing blade 119 to pivot upward toward H in response to encountering the obstruction. For instance, the angled or curved construction of the distal portion 131 may direct an obstruction under the wing blade 119 toward a bottom portion of the main blade 1126 so that the plow 100 rides over the obstruction.

The wing blade 119 in the illustrated embodiment pivots about an area proximal to the pivot portion 118, such that the pivot portion 118 is near to or aligned with the plane of the adjacent segment's blade (e.g., main blade 126). In response to the distal portion 131 encountering an obstruction, the distal portion 131 may begin to ride over the obstruction, causing the wing blade 119 to pivot upward toward position H, and allowing the entire undersurface of the wing blade 119 to ride over the obstruction. In this circumstance, because the undersurface of the wing blade 119 leads to the pivot portion 118 near or aligned with the plane of the blade 126 (e.g., a main blade), the wing blade 119 may raise the blade 126 to clear the obstruction. As described herein, a movable component capable of pivoting in accordance with one or more embodiments described in conjunction with the wing blade 119 may be incorporated into any segment of a plow construction, including segments of a V-blade. And although the wing blade 119 is shown operable to pivot relative to an area proximal to a connection to another segment of a plow, it is to be understood that the wing blade 119 may pivot relative to an area distal from a connection to another segment of the plow.

The wing blade 119 and the blade 126 are wearable components of the snow plow 100, generally meaning that the ground contacting surfaces of the wing blade 119 and the blade 126 wear away in response to repeated contact with the ground. Because the sliding portion 121 of the wing blade 119 is biased downward, in one embodiment, despite wear of the wing blade 119 or the blade 126, or both, the sliding portion 121 may be operable to maintain contact with the ground.

Figure 6:
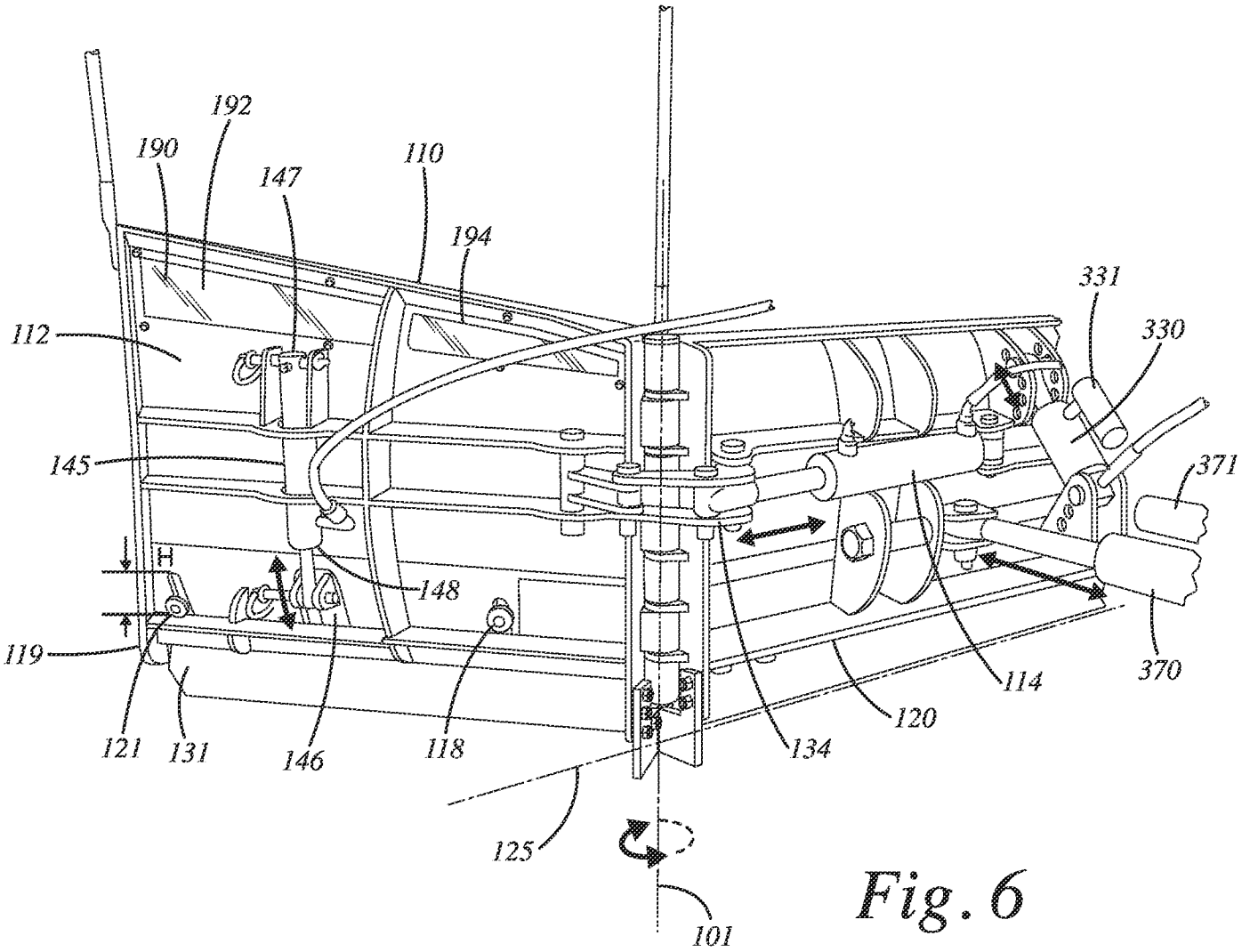
FIG. 6 shows a rear perspective view of a portion of the snow plow of FIG. 1.

Turning to the illustrated embodiments of FIGS. 1 and 6, a rear perspective view of a portion of the snow plow 100 is shown. FIG. 6 shows the rear of the first wing 110 and the primary plow 120. In one embodiment, the wing blade 119 may move from position L to position H based on movement of an actuator 145. In the illustrated embodiment of FIG. 6, the actuator 145 is a hydraulic actuator having a cap side 147 coupled to the main wing portion 112 and a rod side 148 coupled to an anchor 146. The anchor 146 is coupled to the wing blade 119 and operable to move the wing blade 119. In the depicted embodiment, the cap side 147 of the actuator 145 is filled with a compressible gas (e.g., nitrogen gas), which biases the rod toward an extended position, which is downward in the illustrated embodiment. An amount of hydraulic fluid on the rod side 148 of the actuator 145 may be selectively changed, e.g., by increasing or decreasing the fluid pressure on the rod side 148. The hydraulic fluid pressure on the rod side 148 may be transitioned to a float mode in which the hydraulic fluid is neither increasing nor decreasing the fluid pressure on the rod side 148. In this float mode, the compressible gas may extend the actuator 145 until sufficient resistance is met from either the ground by the wing blade 119 or a mechanical limit of extension of the actuator 145.

In one embodiment, in response to the wing blade 119 encountering a sufficient force to overcome the bias of the actuator 145 (e.g., a tripping force or a change in ground contour), the compressible gas of the cap side 147 of the actuator 145 may operate as a spring and allow the rod to move upwards therefore moving the wing blade 119. In response to a force sufficient to overcome the spring force (e.g., the bias force) of the compressed gas, more hydraulic fluid may flow into the rod side 148 of the actuator 145 while the compressible gas compresses (optionally, compressing in an external accumulator). If the force is no longer present, the compressible gas may expand from an accumulator (internal and/or external) back to the cap side 147 of the actuator 145, biasing the rod downwards or to an extended position and moving the wing blade 119 to maintain contact with the ground. The fluid on the rod side 148 may be forced back to the tank of the hydraulic system by the compressible gas with the force no longer being present. The compressible gas may keep or maintain the sliding portion 121 of the wing blade 119 in contact with the ground (or at a set position) even while the other portions of the wing blade 119 wear away, and even in cases where other portions of the wing blade 119 are worn such that they are no longer in contact with the ground. It is to be understood that the actuator 145 is one example of a tripping mechanism, ground follow mechanism, or bias mechanism to a set position, or any combination thereof, and that any type of tripping mechanism, ground follow mechanism, or bias mechanism may be used in conjunction with the wing blade 119 to facilitate yielding in response to encountering a tripping force and/or in response to forces that overcome the bias force of the actuator 145. The hydraulic fluid on the rod side 148 in this example may be provided in a float mode that allows the fluid to readily pass into and out of the rod side 148 in response to movement of the actuator 145.

The vehicle mount 1112, in the illustrated embodiment of FIGS. 1-6, is attached to a frame of the vehicle 10. The vehicle mount 1112 may be installed at the time of manufacture or by a third party in a retrofit of the vehicle 10.

The vehicle mount 1112 in the illustrated embodiment may include a guide slot 1114 operable to receive and guide a lower pin 415 to a lower receiver 1116, which may be in the form of a hook operable to support and maintain a position of the lower pin 415. The vehicle mount 1112 may include an upper receiver 1118 operable to receive a moveable upper pin 419, which can be moved via a handle 421, which is depicted in the illustrated embodiment of FIG. 4, and which is spring loaded to return the upper pin 419 into the upper receiver 1118 if present.

The vehicle support 412 along with the snow plow 100 may be removably coupled to the vehicle mount 1112. An example process for removing the snow plow 100 is described in U.S. Nonprovisional application Ser. No. 17/577,158 entitled PLOW ASSEMBLY, filed Jan. 17, 2022—the disclosure of which is hereby incorporated by reference in its entirety.

Figure 2:
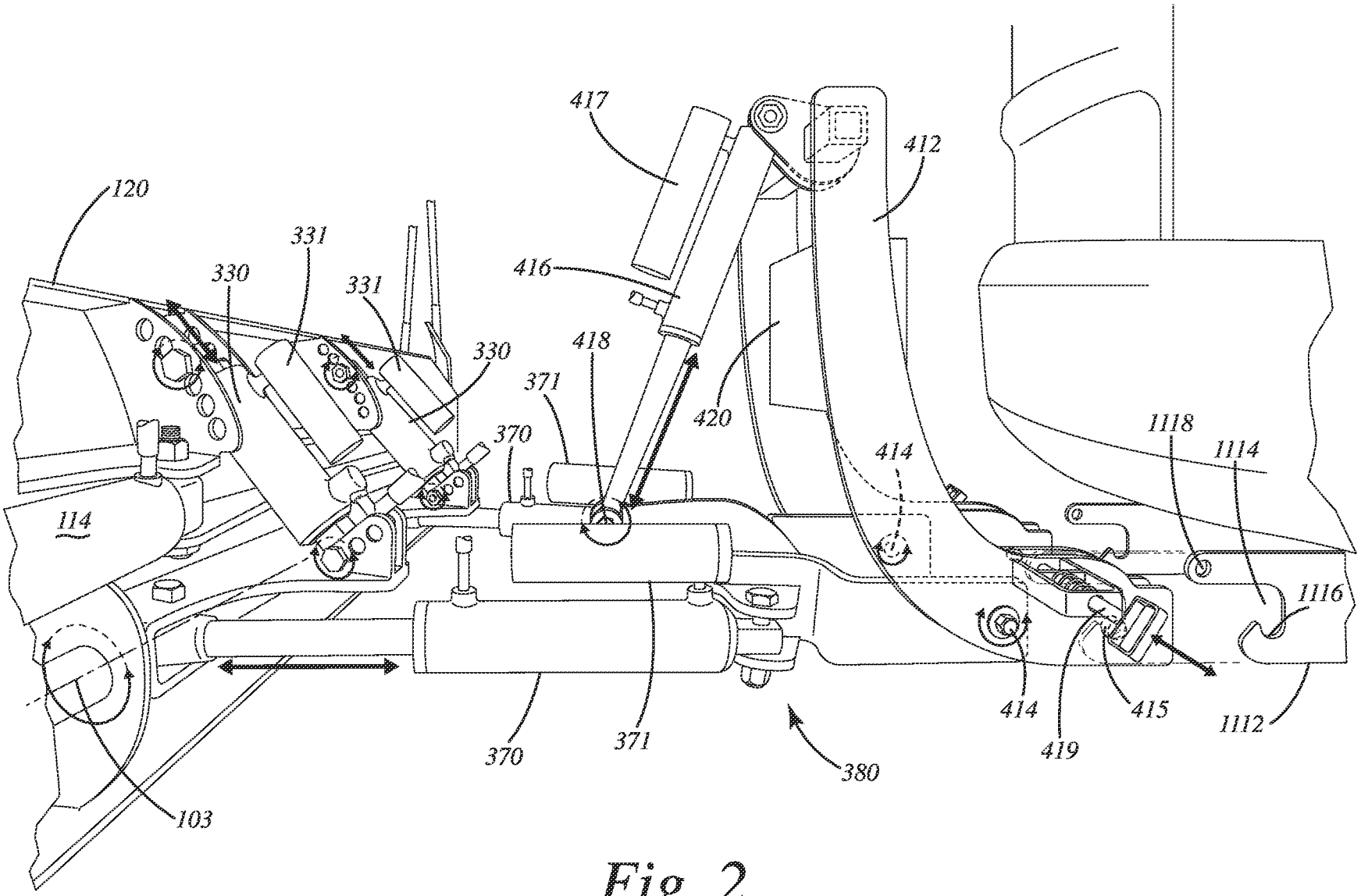
FIG. 2 shows a side view of the snow plow of FIG. 1.

In the illustrated embodiment of FIG. 2, another view of the rear of the snow plow 100 is shown. FIG. 2 focuses on the primary plow 120, and depicts two actuators 330 connected to the rear of the primary plow 120. On the rod side of the actuators 330 and at an angle, the actuators 330 are coupled to the primary plow 120 in a pivotal manner. On the cylinder side of the actuators 330, the actuators 330 are attached to a plow interface 340, about which the primary plow 120 may pivot. It is to be understood that the actuators 330 may be coupled to the primary plow 120 and the plow interface 340 in a different manner, such as, for example, with the rod side of the actuators 330 coupled to the plow interface 340.

The plow interface 340, in the illustrated embodiment, is secured to the rear of the primary plow 120 in a pivotable manner, such that the primary plow may pivot about a longitudinal axis 103 parallel to a forward face of the primary plow 120 (e.g., parallel to the mold board 124). The actuators 330 may extend and retract to rotate the primary plow 120 about this longitudinal axis 103. The actuators 330 may be coupled to the mold board 124, as depicted in the illustrated embodiment, and can be secured to the primary plow 120 by any suitable means, including removable pins.

In the illustrated embodiment, the actuators 330 are hydraulic actuators with compressible gas on the rod side of the actuator 330 and hydraulic fluid on the cap side of the actuator 330 such that the rod is retracted and biased inward by the compressible gas on the rod side, e.g., with the hydraulic fluid on the cap side being in a float state. The rod side of the actuator 330 may include an accumulator 331, integral or external to the actuator 330, filled with the compressible gas. The actuators 330 may be operable in a manner similar to the actuator 145, with the exception of the actuator 330 being configured to extend instead of retract in response to application of a threshold force. It is noted that the hydraulic system may be transitioned from a float state to an active state that involves one or more of retracting the lift actuator 416, extending the actuators 330, retracting the actuators 145 operable to raise and lower the wing blades 119, and retracting the actuators 370. Transitioning back to a float state may allow the compressible gas to do the reverse, including one or more of extending the lift actuator 416, retracting the actuators 330, extending the actuators 145 operable to raise and lower the wing blades 119, and extending the actuators 370. The compressible gas associated with each of these actuators may bias portions of the snow plow 100 toward one or more biased positions, which can be overcome by application of force such as contact with the ground or an obstruction.

In one embodiment, one or more actuators may be operable to control movement of different parts of the snow plow 100, including different types of components in different movements (such as the lift actuator 145, actuators 330, actuators 370, and the actuators 145). Such one or more actuators may operate in conjunction with each other to provide freedom of movement for the snow plow 100 in multiple directions for components of the snow plow 100 in response to encountering an obstruction. In other words, different longitudinal axes may be provided for a plurality of actuators that move in response to encountering an obstruction. For example, in response to the mold board 124 of the snow plow 100 encountering an obstruction, the lift actuator 416 may retract, the actuators 330 may extend, and the actuators 370 may retract. This movement of the lift actuator 416, the actuators 330, and the actuators 370 may be enabled via compression of gas provided in the respective actuators. In this way, multiple components of the snow plow 100 may yield or move in response to a portion of the snow plow 100 encountering an obstruction.

In another example, if the primary plow 120 encounters a tripping force (e.g., in response to the main blade 126 of the primary plow 120 encountering an obstruction), the compressible gas may operate in a spring-like manner, allowing the actuators 330 to extend as the gas further compresses. If the actuators 330 are coupled to external accumulators, gas in the rod side and the accumulator may compress within the external accumulator and hydraulic fluid may be supplied to the cap side of the actuator 330 as the rod extends. As the rod extends, the primary plow 120 may rotate about the longitudinal axis 103 such that the blade 126 of the primary plow 120 moves toward the vehicle 10 while the upper edge of the primary plow 120 moves away from the vehicle 10. If the tripping force occurred because the primary plow 120 encountered an obstruction, this tripping behavior may reduce or minimize damage to the primary plow 120 and the snow plow 100. Although, in this example, the actuators 330 are described as extending in response to the snow plow 100 encountering an obstruction force, additional or alternative actuators of the snow plow 100 may extend or retract in response to the snow plow 100 encountering an obstruction. For instance, in addition to extension of the actuators 330, the lift actuator 416 and/or the actuators 370 may retract in response to the snow plow 100 encountering the obstruction.

In the illustrated embodiment, the snow plow 100 may include a hydraulic system 420. The hydraulic system 420 may be hydraulically coupled to the actuators of the snow plow to control movement thereof. The hydraulic system 420 may include a single hydraulic coupling for each of the actuators of the snow plow 100 (or a subset thereof), including the lift actuator 416, the actuators 330, the actuators 370, and the actuators 145. The single hydraulic coupling may be operable to control supply of fluid to one side of the actuators, while the other side of the actuators may be filled with compressible gas (which is optionally in gaseous communication with an accumulator). In one embodiment, the actuators having a single hydraulic coupling (e.g., the lift actuator 416, the actuators 330, the actuators 370, and the actuators 145) may be controlled together via a hydraulic valve operable to control the supply of hydraulic fluid to all of these actuators simultaneously. In one embodiment, the single hydraulic couplings may define branch circuits that are linked to a source hydraulic circuit, for which hydraulic fluid is controlled by the hydraulic valve. In other words, the hydraulic couplings for the one or more of the lift actuators 416, the actuators 330, the actuators 370, and the actuators 145 may all form part of the same hydraulic circuit, for which hydraulic fluid is controlled by the hydraulic valve. With this configuration, hydraulic actuation of the lift actuator 416, the actuators 330, the actuators 370, and the actuators 145 may be conducted simultaneously, such as to transition the snow plow 100 from an operable position to a transport position, at which the primary plow 120 is raised relative to the ground, the wing blades 119, 219 are raised to position H relative to the ground, and the primary plow 120 is tilted forward about the longitudinal axis 103. In one embodiment, because the primary plow 120 is tilted forward about the longitudinal axis 103 and the wing blades 119, 219 are raised to position H, the wings 110, 210 may be rotated to position B, via control by the hydraulic system 420, in a manner that provides ground clearance for travel and maintains a left to right width of the vehicle 10 that fits within a standard lane size of the road.

The actuators 330 in the illustrated embodiment are respectively coupled to the rear of the primary plow 120 via an upper mount and to the plow interface 340 via a lower mount. The upper mount may include first and second upper plates spaced apart to receive an upper end portion of the actuator 330. The first upper plate may include a plurality of apertures that are respectively axially aligned with a corresponding plurality of apertures disposed in the second upper plate. The apertures may accept a pin or bolt that rotatably couples to an upper end portion of the actuator 330 to the upper mount.

The apertures of the first and second upper plates may be spaced relative to each other to enable coupling of the actuator 330 to the upper mount at a plurality of positions. For example, the plurality of positions of the upper mount may enable coupling the upper end portion of the actuator 330 at different positions, some closer to the longitudinal axis 103 and some farther from the longitudinal axis 103. The lower mount for the actuators may be similar in some respects to the upper mount, including first and second lower plates spaced apart to receive a lower end portion of the actuator 330. The first and second lower plates may each include a plurality of apertures that are axially aligned and provide for multiple coupling positions for the actuator 330. The plurality of apertures of the lower mount may enable coupling the lower end portion of the actuator 330 at different positions, some closer to the longitudinal axis 103 and some farther from the longitudinal axis 103.

In practice, it is noted that the mounting position of the actuator 330 relative to the plow interface 340 and the primary plow 120 may be varied or adjusted to configure the snow plow 100 for use with a particular truck. For instance, a height of one vehicle 10 may be different from the height of another vehicle 10. The mounting positions of the actuators 330 may be adjusted to set the angle of the primary plow 120 (and the angles of the first and second wings 110, 210) relative to the ground.

An upper end of the actuator 330 may be mounted via a pin to one of a plurality of available positions provided by the upper mount, and the lower end of the actuator 330 may be mounted via a pin to one of a plurality of available positions provided by the lower mount. By selecting upper and lower mounting positions for the actuator 330, an installer or maintenance worker can tune the snow plow 100 to the ground (e.g., an angle of the snow plow relative to the ground and the truck), enabling different truck configurations without changing the mounting iron (e.g., the vehicle mount 1112 and/or vehicle support 412) or construction thereof. For instance, the installer or maintenance worker may select sets of holes from the upper and lower mounts for the actuator 330 for setting both the length and angle of the actuator 330 relative to the primary plow 120 and the plow interface 340.

In one embodiment, a geometry of the snow plow 100 relative to the truck and the ground may vary over time (e.g., as one or more blades wear). A maintenance worker may adjust the upper position or lower position, or both, of the actuator 330 relative to the upper and lower mounts in order to re-adjust the position of the primary plow 120 with respect to the ground and the truck. For instance, the upper end portions of the actuators 330 may be moved to sets of apertures that are 2 inches farther from the longitudinal axis 103, and the low end portions of the actuators 330 may be moved to sets of apertures that are 0.5 inches closer to the longitudinal axis.

In the illustrated embodiment, the angle of the primary plow 120 relative to the ground and truck may affect the angle of the axes 101, 201 of the first and second wings 110, 210 relative to the ground. This angle may affect the available travel and pivot angle of the wing blades 119, 219 between positions H and L. As the main blade 126 wears, a portion of the wing blades 119, 219 proximal to the axes 101, 201 may wear, potentially causing the distal portion 131, 231 of the wing blades 119, 219 to rise toward position H despite less wear than the portion of the wing blades 119, 219 proximal to the axes 101, 201. This movement toward position H may limit the amount of upward travel of the wing blades 119, 219 that is available in response to encountering an obstruction.

To account for the effects of blade wear, including the limiting of available movement toward position H for the wing blades 119,219, the mounting locations of the actuators 330 may be adjusted to change the angle of the primary plow 120 relative to the ground. For instance, the mounting locations of the actuators 330 may be adjusted to pivot an upper portion of the primary plow 120 away from the vehicle 10, thereby angling the axes 101, 201 to provide a greater amount of travel for distal portions 131, 231 of the wing blades 119, 219 between position H and the ground (despite wear of the main blade 126). In other words, by adjusting the mounting locations of the actuators 330 and the angle of the axes 101, 201, despite wear of the main blade 126, an operating position of the wing blades 119, 219 may be re-adjusted to be similar to the operating position of the wing blades 119, 219 prior to the blade wear and enabling a similar amount of travel (e.g., 3 inches of upward motion) between the operating position and position H in response to encountering an obstruction. In the illustrated embodiment, each of the actuators 114 of the snow plow 100, in the illustrated embodiment, may be coupled to the hydraulic system 420 via first and second hydraulic couplings, enabling the hydraulic system to actively control an angular position of each of the wings 110, 210 between the F and B positions.

The operation of the compressible gas and hydraulic system 420 in conjunction with the snow plow 100 is similar in many respects to the operation of the compressible gas and hydraulic system of the snow plow 100. In one embodiment, the snow plow 2000 may be configured such that the lift actuator 416, as depicted in the illustrated embodiment of FIG. 2, may be provided with compressible gas on one side of the lift actuator 416. The compressible gas in the illustrated embodiment may be provided on the cylinder side of the lift actuator 416, optionally in conjunction with an accumulator 417, and biasing the lift actuator 416 to an extended position if the hydraulic fluid on the rod side of the lift actuator 416 is allowed to float or return to the tank. With the snow plow 100 positioned in an operable position, the bias of the lift actuator 416 may provide downforce on the plow support 380 to bias the primary plow 120 and the wings 110, 210 toward the ground. With the ground contour changing as the snow plow 100 is driven over the ground, the lift actuator 416 may vary in length via compression of the compressible gas on the cylinder side of the lift actuator 416. In other words, the changes in ground height may overcome the bias force of the lift actuator 416 (or downforce of the lift actuator 416), allowing the primary plow 120 and the wings 110, 210 to follow the contour of the ground.

In the illustrated embodiment, the accumulator 417 is depicted as being coupled directly to the lift actuator 416. It is to be understood that the accumulator 417 may be separate from the lift actuator 416, and directly fluidly coupled to the lift actuator 416. It is also to be understood that the accumulator 417 regardless of whether the accumulator 417 is mounted directly to or separate from the lift actuator 416, the accumulator 417 may be indirectly fluidly coupled to the lift actuator 416. For instance, the accumulator 417 may be indirectly fluidly coupled to the lift actuator via a pneumatic valve as described herein. In one embodiment, the accumulator 417 may be integrated with a structural component of the snow plow 100 to form a structural integrated accumulator—e.g., the accumulator 417 may be provided by an internal space of a structural tubular member of the snow plow 100. More specific to this example, the accumulator 417 may be provided by the cross member of the vehicle support 412 to which the upper portion of the lift actuator 416 is coupled. A Schrader valve may be mounted to a flange that forms a seal with an internal cavity of this cross member, which is depicted in the illustrated embodiment of FIG. 2. A gas line may also be coupled to the structural integrated accumulator, where the gas line may be directly coupled to the lift actuator 416 or indirectly via a pneumatic valve. In the indirect configuration, another gas line may couple the pneumatic valve directly to the lift actuator 416.

A control system in accordance with one embodiment for operation of the actuator 145 may enable retraction and extension the first wing 110. The control system may be configured to direct operation of one or more other actuators in a similar manner.

In addition to the operation of the actuator 145 described in conjunction with tripping in response to an obstruction and/or moving based on changes in the ground contour, a control system may be operable to direct operation of the actuator 145. The control system may provide manual control, electromechanical control, or a combination of the two, over the plow. An operator may control the position of the snow plow 100 by signaling the control system to control the hydraulic fluid in the system, such as by extending or retracting the lift actuator 416. If an operator directs the snow plow 100 to move upward, for example to raise the snow plow 100 for stacking or transport, the operator may signal (e.g., provide user input) to the control system to supply more hydraulic fluid to the rod side of the actuator 416, thus causing the rod to retract. The supply of hydraulic fluid to the rod side of the actuator 416 may also be fluidly coupled to the rod side 148 of the actuator 416, such that, in response to providing hydraulic fluid under pressure to the rod side of the actuator 416, the actuator 145 for the wing blade 119 retracts first (compressing the gas) until a mechanical limit of retraction is reached, and then the lift actuator 416 raises and retracts.

Conversely, if the operator provides a signal to the control system to lower the snow plow 100, the system may supply hydraulic fluid to the cap side of the lift actuator 416 under pressure and may cause the lift actuator 416 to extend, and displace fluid from the rod side of the lift actuator 416 under pressure. Because the actuator 145 is fluidly coupled to the rod side of the lift actuator 416, this pressure on the rod side of the lift actuator 416 may maintain the position of the actuator 145 in the retracted position (with the gas in a compressed state). After the lift actuator 416 is fully extended such that the snow plow 100 contacts the ground (or the mechanical limit of the lift actuator 416 is reached), the pressure on the rod side of the lift actuator 416 (due to supply of fluid to the cap side) may subside and the actuator 145 may extend because the compressed gas in the actuator 145 is no longer under pressure from fluid on the rod side 148 of the actuator 145. In this way, the actuator 145 may automatically extend in response to the snow plow 100 contacting the ground, and may automatically retract just prior to the snow plow 100 being raised off the ground.

The control system may receive a directive from the operator to lower the snow plow 100. Hydraulic fluid may be provided to the lift actuator 416 under pressure to cause the lift actuator 416 to extend. In response, hydraulic fluid may be evacuated from the lift actuator 416 under pressure, maintaining the actuator 145 in a retracted position. After the lift actuator 416 extends the plow to the ground position, pressure on the rod side 148 of the actuator 145 may subside, allowing the compressed gas to extend the actuator 145 to move the wing blade 119 into contact with the ground. The compressed gas may bias the wing blade 119 toward ground contact, and may allow the wing blade 119 to move upward automatically in response to changes in the ground contour and/or engagement with an obstruction.

If the control system has received a signal from an operator requesting to move the snow plow 100, the control system may determine if the signal pertains to an upward movement request. If the operator has requested upward movement, the hydraulic system may push hydraulic fluid to the rod side of the lift actuator 416. In one embodiment, in response to additional hydraulic fluid on the rod side of the lift actuator 416 and the actuator 145, the pressure of the compressible gas may increase, while the rod retracts and the wing blade 119 moves upward toward position H. After the actuator 145 can retract no further, the pressure on the rod side of the lift actuator 416 may cause the lift actuator 416 to retract.

In the embodiment depicted in FIGS. 3 and 6, an actuator 114 is provided to operably rotate the first wing 110 about the first axis 101 between the F and B positions. The actuator 114 may be a hydraulic actuator with its rod coupled to a bracket 134 and its cylinder coupled to the back of a mold board 124 of the primary plow 120. As the rod retracts and extends, the rod actuates the bracket 134 to rotate the first wing 110 about the axis 101. In the illustrated embodiment, the actuator 114 may have hydraulic fluid on both the rod side and the cap side of the cylinder. Alternatively, the cap side of the actuator 114 may include compressible gas operable to bias the actuator 114 toward an extended position, but operable to allow the first wing 110 to move toward position B in response to encountering a force that overcomes the bias force of the actuator 114 (e.g., encountering an obstruction). Alternatively, the rod side of the actuator 114 may include a compressible gas operable to bias the actuator 114 toward the retracted position B, and hydraulic fluid may be supplied or removed from the cap side to position the actuator 114 at position F or between position F and B, compressing the gas on the rod side of the actuator 114. In this configuration, if the first wing 110 encounters an obstruction as the vehicle is being backed up (e.g., backing up while the first wing 110 encounters a light post), the actuator 114 may automatically extend and allow the first wing to rotate toward position F.

It is to be understood that any of the actuators described herein with compressible gas may be positioned in this manner by supplying or removing hydraulic fluid on the side opposite of the compressible gas, or allowed to float such that the compressible gas biases the actuator to a mechanical limit of the actuator and/or the plow portion coupled to the actuator.

An operator may use the control system to rotate the first wing 110 in accordance with the operator's directive in operation. When the control system adds hydraulic fluid to the cap side of the actuator 114 and removes hydraulic fluid from the rod side of the actuator 114, the rod extends and the first wing 110 rotates about the axis 101 away from the vehicle 10 to the requested position up to position F. When the control system adds hydraulic fluid to the rod side of the actuator 114 and removes hydraulic fluid from the cap side of the actuator 114, the rod retracts and the first wing 110 rotates around the axis 101 toward the vehicle 10 to the requested position up to position B. The extent to which the first wing 110 can rotate in either direction around the axis 101 may depend on the application. The second wing 210 rotates in a similar manner but may have a different range of rotation than the first wing 110, e.g., position F for the second wing 210 may not correspond to position F for the first wing 110.

In an alternative embodiment, the actuator 114 may be operable to allow the first wing 110 to pivot toward the vehicle 10 up to position B in response to the snow plow 100 encountering an object that exerts a force greater than a tripping threshold or bias threshold. For example, the actuator 114 may be configured to retract the rod in response to a force that is applied on the first wing 110 in a direction normal or perpendicular to the first axis 101 and that is greater than the tripping threshold. In this way, the first wing 110 may be configured to yield in response to encountering an obstruction thus potentially limiting damage to the first wing 110 and the snow plow 100. While the actuator 114 is used in this example, it is to be understood that any type of tripping mechanism may be implemented in conjunction with the first wing 110 to facilitate yielding in response to encountering significant obstructions, including compressed gas on one-side of the actuator 114.

In FIGS. 2 and 4, two actuators 330 are shown and are connected to the rear of the primary plow 120 on the rod side and at an angle. On the cylinder side, the actuators 330 are attached to a plow interface 340, about which the primary plow 120 may pivot. The plow interface 340 is secured to the rear of the primary plow 120 in a pivotable manner, such that the primary plow may pivot about a longitudinal axis 103 parallel to a forward face of the primary plow 120 (e.g., parallel to the mold board 124). The actuators 330 may extend and retract to rotate the primary plow 120 about this longitudinal axis 103. The actuators 330 may be coupled to the mold board 124, as depicted in the illustrated embodiment, and can be secured to the primary plow 120 by any suitable means, including removable pins.

In the illustrated embodiment, the actuators 330 are hydraulic actuators with compressible gas on the rod side of the actuator 330 and hydraulic fluid on the cap side of the actuator 330 such that the rod is retracted and biased inward by the compressible gas on the cap side. The rod side of the actuator 330 may include an accumulator, integral or external to the actuator 330, filled with the compressible gas. The actuators 330 may be operable in a manner similar to the actuator 145, with the exception of the actuator 330 being configured to extend instead of retract in response to a threshold force whereas the actuator 145 may be retracted in response to a threshold force. For example, with the snow plow 100 in the down position with the hydraulic fluid in float mode for the rod side of the lift actuator 416, force applied to the bottom of the mold board 124 may apply longitudinal force on the actuator 330 to compress the compressible gas in the actuator 330 and cause the actuator 330 to extend until a mechanical limit is reached. In response to the blade 126 encountering an obstruction, the actuator 330 may extend compressing the gas.

If the primary plow 120 encounters a tripping force (e.g., in response to the main blade 126 of the primary plow 120 encountering an obstruction), the compressible gas may operate in a spring-like manner, allowing the actuators 330 to extend as the gas further compresses. If the actuators 330 are coupled to external accumulators, gas in the rod side and the accumulator may compress and hydraulic fluid may float supplied to the cap side of the actuator 330 such that the rod extends. As the rod extends, the primary plow 120 rotates about a longitudinal axis 103 such that a blade 126 of the primary plow 120 moves toward the vehicle 10 while the upper edge of the primary plow 120 moves away from the vehicle 10. If the tripping force occurred because the primary plow 120 encountered an obstruction, this tripping behavior may reduce or minimize damage to the primary plow 120 and the snow plow 100. After the tripping force is no longer present, the compressible gas expands in the rod side of the actuator 330 and at least a portion of the hydraulic fluid on the cap side of the actuator 330 may be returned to the hydraulic system, such that the rod of the actuator 330 retracts.

In the illustrated embodiment of FIG. 2, the snow plow 100 is coupled to a vehicle support 412 in a pivotal manner relative to first and second vehicle couplings 414. The vehicle support 412 may be removably coupled to the frame of the vehicle 10, in accordance with one or more embodiments described herein. The plow support 380 may be raised and lowered relative to the vehicle support 412 by a lift actuator 416, which is coupled to the plow support 380 via lift coupling 418. For instance, the lift actuator 416 may be extended to lower the snow plow 100 into contact with the ground, and the lift actuator 416 may be retracted to raise the snow plow 100 for transportation. As described herein, first and second actuators 370 may extend and retract to move the snow plow 100 proximal to and distal from the vehicle 10. In a transport mode, as depicted in FIG. 4, the first and second actuators 370 may retract the snow plow 100, the lift actuator 416 may raise the snow plow 100, and the actuator 114 may move the wings to the B position, such that the snow plow 100 is close to the vehicle, clears the ground, and fits within lane constraints of the road.

The first and second vehicle couplings 414 and a coupling of the lift actuator 416 opposite the lift coupling 418 may be disconnected by an operator to remove the plow support 380 and the snow plow 100 from the vehicle support 412. Alternatively, the snow plow 100 may be removed from the vehicle 10 via a vehicle support 412.

The snow plow 100 is described herein in conjunction with one or more actuators or couplers having compressible gas to bias the actuator or coupler toward a retracted or extended position and to allow extension or retraction in response to an applied force. It is to be understood that the snow plow 100 is not so limited. An external spring or spring-like component may be provided in conjunction with one or more actuators or couplers to bias toward a retracted or extended position and facilitate extension or retraction in response to an applied force. For instance, a compressible spring may be provided in conjunction with the actuator 370 to bias the actuator 370 and the plow toward the O position. In response to the plow encountering an obstruction or a force applied toward position I, the compressible spring may enable the plow and the actuator 370 to retract.

Figure 5:
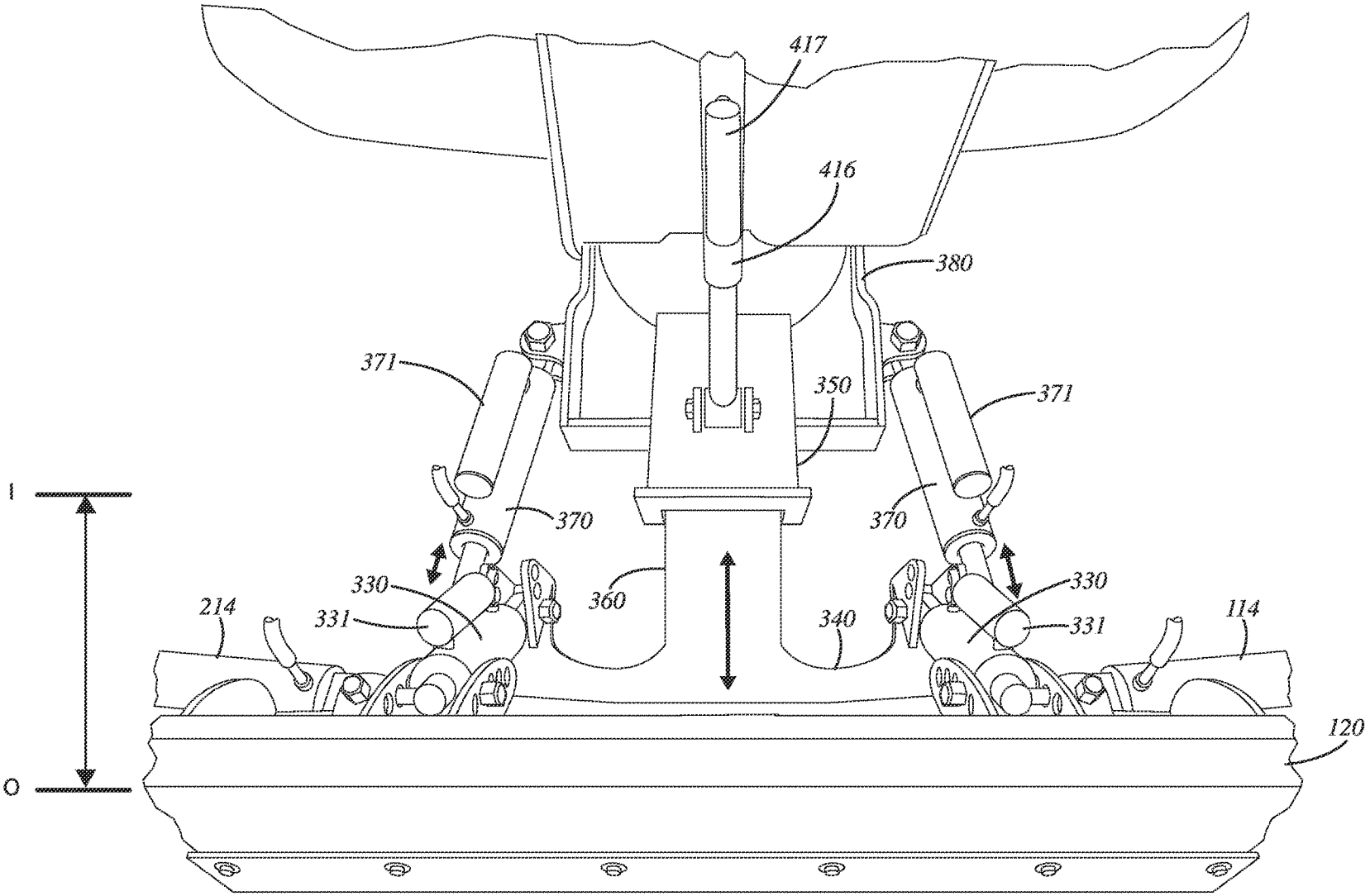
FIG. 5 shows a top view of the snow plow of FIG. 1.

In the illustrated embodiments of FIGS. 2 and 5, the snow plow 100 and the blade 126 may be lifted off the ground by retraction of the lift actuator 416. The angle of the snow plow 100 relative to the longitudinal axis 103 may be varied by the actuators 330. With this arrangement, the forward position and height of the snow plow 100 and blade 126 can be controlled while also maintaining an angle of the snow plow 100 relative to the longitudinal axis 103. In the illustrated embodiment, in response to lifting the snow plow 100 to a raised position, the actuators 330 may extend due to pressure in the hydraulic system and tilt the snow plow forward in a raised position.

In an alternative embodiment, the angle of the snow plow 100 may be controlled separately from the position of the lift actuator 416. For instance, the angle of the snow plow 100 may be kept in a generally vertical manner by extending or retracting the actuators 330 based on the forward position and height of the snow plow 100 determined by the lift actuator 416 and the first and second actuators 370.

By controlling the angle of the snow plow 100 in conjunction with the height and forward position, the snow plow 100 can be maneuvered to comply with road width limitations, avoid contact between the wings 112, 212 and the ground (particularly the tips of the wings 112, 212 as depicted in FIG. 4). Additionally, the snow plow 100 can be transitioned among various modes of operation, including a plow mode with the snow plow 100 in contact with the ground, a stacking mode in which the snow plow 100 is raised for pushing and stacking snow above the ground, and a transportation mode in which the snow plow 100 is stowed for travel. In these various modes, despite changes in height and forward position of the snow plow 100 relative to the vehicle, the angle of the snow plow 100 may be adapted to be generally vertical (or another angle in accordance with operator directive).

To rotate the primary plow 120 backward, the control system may remove hydraulic fluid or remove pressure from the cap side of the actuator 330 so that the compressible gas can further retract the rod. Depending on the height of the primary plow 120 and the first and second wings 112, 212, and the position of the first or second wings 112, 212 relative to the B and F positions, the primary plow 120 may be limited in rotating backward around the longitudinal axis 103 because the first wing 110 and the second wing 210 may come into contact with the ground. Contact in this manner may cause wear or damage to the wing blades 119, 219. The angle of the primary plow 120 and/or the height of the wing blades 119, 219 may be adjusted as the height of the primary plow 120 is varied by retraction of the lift actuator 416.

In the illustrated embodiment, the vehicle support 412 may be removably coupled to the frame of a vehicle 10, via a vehicle mount 1112. The snow plow 100 may be releasably coupled to the vehicle 10 via coupling between the vehicle support 412 and the vehicle mount 1112. The snow plow 100 can be retrofitted for a range of mounting configurations for the vehicle 10 and is not limited to the vehicle support 412.

In one embodiment, the plow support 380 of the snow plow 100 comprises a receiver 350, which may be configured to support a receiver interface 360. The plow support 380 may removably attach to the vehicle support 412. The receiver 350 of the plow support 380 and the receiver interface 360 may allow the snow plow 100 to move proximally and distally relative to the vehicle 10. As shown in FIGS. 2 and 5, the receiver 350 is coupled to the plow support 380, and the plow support 380 is attached to the vehicle support 412. Alternatively, the receiver 350 may be coupled directly to the vehicle support 412. In the depicted embodiment, the receiver 350 defines an opening configured to receive a receiver interface 360 and the receiver interface 360 is movably coupled to the receiver 350. For example, the receiver interface 360 may be a protrusion or a shank. As depicted, the receiver interface 360 forms part of the plow interface 340 and extends from the rear surface of the primary plow 120. In an alternative embodiment, the receiver interface 360 may be a separate component from the plow interface 340 and may not be coupled to the plow interface 340. In another alternative embodiment, the receiver interface 360 may be a separate component from the plow interface 340 but may be coupled to the plow interface 340. In one embodiment, the receiver 350 and the receiver interface 360 are operable to restrict movement in directions perpendicular to a longitudinal axis of the receiver 350 such that movement is substantially prevented in directions perpendicular to the longitudinal axis.

The receiver 350 may be coupled to at least one actuator 370 via the plow interface 340. The actuators 370 may be coupled to the plow support 380 on the cylinder side and to the plow interface 340 on the rod side. In an alternative embodiment, the actuators 370 may be directly coupled to the receiver 350 on the cylinder side, directly coupled to the mold board 124 on the rod side, or both. As depicted, the actuators 370 are hydraulic actuators with hydraulic fluid on both the rod side and compressed gas on the cap side of the cylinder. The actuators 370 may be biased in the extended position via compressed gas on the cylinder side of the actuators 370, and operative to retract in response to a force greater than the bias force of the actuators 370 (e.g., in response to the snow plow 100 encountering an obstruction.) The actuators 370 may be controlled by providing hydraulic fluid under pressure to the rod side of the actuators 370 to retract the actuators 370. If pressure is removed from the rod side of the actuators 370, the actuators 370 may extend until mechanically limited based on expansion of the compressible gas.

In an alternative embodiment, the receiver 350 may attach to the primary plow 120 and the receiver interface 360 may attach to the plow support 380. The actuator 370 may be mounted with the rod side attached to the plow interface 340 (as shown) or the plow support 380.

An operator can control the distance between the snow plow 100 and the vehicle 10 by directing the control system to move the snow plow 100 between position O and position I. In response to receiving a command from an operator to move the snow plow 100 toward position I, the control system may supply hydraulic fluid to the rod side of the actuator 370, further compressing compressible gas on the cylinder side of the actuator 370. In the illustrated embodiment, the actuators 370 include external accumulators 371 coupled to the cylinder side and capable of storing compressible gas in conjunction with the cylinder side of the actuators 370. The external accumulator 371 may facilitate greater length of travel for the actuator 370 relative to a configuration without the external accumulator 371, providing gas of sufficient pressure throughout the range of motion of the actuator 370 and sufficient bias force to retract in response to an obstruction but not in response to pushing snow or debris. In an alternative embodiment, the actuators 370 may not include compressible gas on the cylinder side, and may be actuated by hydraulic fluid in a push-pull coordinated manner on the cylinder side and rod side.

Movement toward position I causes the receiver interface 360 to slide further into the receiver 350. Position I is the closest the snow plow 100 can be moved to the vehicle 10 proximally, and may vary from application to application depending on the construction. Position I may be the position of the snow plow 100 when the rods of the actuators 370 are fully retracted. Alternatively, or additionally, position I may be the position of the snow plow 100 when the receiver interface 360 is fully seated in the receiver 350. In another embodiment, position I may be the position of the snow plow 100 when the receiver interface 360 contacts a back edge of the receiver 350, which may or may not be the point at which the receiver interface 360 is fully covered by the receiver 350.

If the control system receives a command from an operator to move the snow plow 100 toward position O, the control system may withdraw hydraulic fluid to the rod side of the actuator 370. This causes the rods to extend and the receiver interface 360 to slide out of the receiver 350. Position O may correspond to the farthest the snow plow 100 can be disposed from the vehicle 10 distally. In one embodiment, position O is reached when the rods of the actuators 370 are fully extended. In one embodiment, the rods are 14" long. Additionally, or alternatively, position O may be the position of the snow plow 100 when the end of the receiver interface 360 reaches the end of the receiver 350. In one embodiment, position O is selected to substantially prevent overextension of the actuators 330. For example, if the cylinder side of the actuators 330 is coupled to the plow support 380 rather than the plow interface 340, position O may be selected to be more proximal to the vehicle 10 in order to prevent overextension of the actuators 330.

As described herein, the actuators 370 may have compressible gas on the cap side of the cylinder and hydraulic fluid on the rod side of the cylinder such that the rod is biased in the extended position. Thus, the primary plow 120 is biased at position O. When the primary plow 120 comes into contact with a force above a tripping threshold or overcomes a bias force of the actuators 370, the actuators 370 may operate in a spring-like manner, and hydraulic fluid is provided to the rod side of the cylinder and the compressible gas compresses further in the cylinder side and the external accumulator 371 such that the rod of each actuator 370 retracts and moves the primary plow toward position I. The primary plow 120 may move all the way to position I or may move to some position between position O and position I depending on the strength of the obstruction force. This allows the primary plow 120 to yield when encountering an obstruction which may prevent or reduce damage to the snow plow 100. When the obstruction force is no longer present, hydraulic fluid may be withdrawn from the rod side of the actuator 370 (e.g., automatically in response to pressure from the gas) and the compressible gas may expand such that the actuators 370 are once again biased toward the extended position and the primary plow 120 returns to position O or a position between O and I at which the operator has selected for operation.

If the vehicle 10 with the snow plow 100 is travelling from place to place, it can be configured in a transport mode as depicted in the illustrated embodiment of FIG. 4. The snow plow 100 can be in a variety of positions during transport mode. For example, the primary plow 120 may be tilted forward about the longitudinal axis 103 and the first wing 110 and the second wing 210 may be rotated around the axes 101, 201 back toward the vehicle 10. This lifts the blade 126 off the ground and keeps it behind the primary plow 120 while driving such that the blade 126 is not the first point of contact if the snow plow 100 comes into contact with an obstruction. The control system may move the snow plow 100 to this position by adjusting the length of the lift actuator 416, the actuators 330, the actuators 370, and the actuators 114, 214. To tilt the primary plow 120 forward, the control system supplies hydraulic fluid to the cap side of the actuators 330 further compressing the compressible gas. This causes the rods of the actuators 330 to extend, pushing the top edge of the primary plow 120 forward and consequently tilting the blade 126 toward the vehicle 10. To move the first wing 110 and the second wing 210 backwards, the control system removes hydraulic fluid from the cap side of the actuators 114, 214 and supplies hydraulic fluid to the rod side of the cylinders of the actuators 114, 214, which causes the rods to retract. As the rods retract, the first wing 110 is rotated about the axis 101 toward the vehicle 10 and the second wing 210 is rotated about the axis 201 toward the vehicle 10. As the primary plow 120 tilts forward, the outer edge of the first wing 110 and the second wing 210 and the wing blades 119, 219 lift off the ground and rotate toward the vehicle 10. This may provide a safer transport mode because all blades are rotated back toward the vehicle 10.

There are applications where controlling the distance of the snow plow 100 relative to the vehicle 10 is useful. For example, when parking the vehicle 10, an operator may want to move the snow plow 100 closer to the vehicle 10 in order to allow the vehicle 10 to better fit into a parking space. An operator may want the snow plow 100 to be further away from the vehicle 10 when plowing in order to minimize blowback of the snow onto the vehicle 10 or to provide less clearance between the snow plow 100 and the vehicle 10 when the snow plow 100 is actuated to its transport mode. The closer the snow plow 100 is to the vehicle 10 during transport, the closer the center of gravity of the vehicle 10 and the snow plow 100 is to the vehicle's center of gravity without the snow plow 100, and the more even the weight of the system is distributed over the wheels.

Although a moveable portion (e.g., a wing blade 119) is described in conjunction with a wing 110 relative to a primary plow 120, it is to be understood that the present disclosure is not so limited. The snow plow 100 may include any number of segments, such as two segments that form the primary plow 120 capable of forming a V-configuration (e.g., a V plow). As another example, the snow plow 100 may include four segments, including two segments that form a V-configuration and two wings respectively coupled to one of the two segments that form the V-configuration. Any segment of the snow plow 100 may include a movable portion configured according to one or more embodiments described herein. For instance, a V-plow may include wing blades 119 capable of rotating upward and downward relative to a pivot point to follow the ground contour and/or move in response to encountering an obstruction. In another example, with a four segment plow, each segment may include a rotatable or movable portion capable of following the ground.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. A snow plow for a vehicle, the snow plow comprising:

a plow portion including first and second sides opposite each other, the plow portion including a plow face operable to direct snow, the plow face including a lower portion and an upper portion, the plow portion being rotatably coupled to another plow portion via a joint, the plow portion operable to rotate via the joint toward a side of the vehicle, the plow portion being raisable off the ground and rotatable toward the side of the vehicle for transport;

a blade coupled to the plow portion, the blade operable to contact a ground surface to facilitate moving snow;

a window coupled to the upper portion of the plow face, the window being transmissive to light output from the vehicle, the window providing an operable surface for moving snow, wherein, with the plow portion rotated toward the side of the vehicle and raised off the ground for transport, the window is configured to permit passage of light output from a vehicle head light and directed transverse with respect to a longitudinal axis of the vehicle outward from the side of the vehicle; and a plow support operable to support the plow portion.

2. The snow plow of claim 1 wherein the upper portion of the plow portion includes a window support frame that defines an aperture, and wherein the window is supported by the window support frame.

3. The snow plow of claim 1 wherein the plow support is removably coupled to a vehicle support.

4. The snow plow of claim 1 comprising an actuator operable to move the blade from a first position to a second position, wherein the actuator includes a compressible gas operable to bias the blade to a bias position.

5. The snow plow of claim 1 wherein the blade is disposed between the first and second sides of the plow portion.

6. The snow plow of claim 1 comprising a first wing that is rotatably coupled to the first side of the plow portion via a first connection, the first wing being configured to rotate about a first axis substantially parallel to the first side of the plow portion.

7. The snow plow of claim 1 comprising a main plow as the other plow portion and including a first main plow side and a second main plow side, and wherein the first side of the plow portion is rotatably coupled to the first main plow side via the joint such that the plow portion is operable to rotate about a first axis.

8. The snow plow of claim 7 wherein the plow portion is a main wing portion operable to rotate about the first axis between a backward position and a forward position, and where the plow portion is rotatable to an intermediate position between the backward position and the forward position.

9. The snow plow of claim 8 wherein:

the intermediate position corresponds to the plow face being substantially transverse with respect to a longitudinal axis of the vehicle, the plow face extends outward relative to a plane defined by a side of the vehicle; and the window coupled to the upper portion of the plow portion provides transmissibility for light generated from the vehicle and traveling outward relative to the plane defined by the side of the vehicle.

10. The snow plow of claim 8 comprising:

a second wing that is rotatably coupled to the second side of the plow portion via a second connection, the second wing being configured to rotate about a second axis substantially parallel to the second side of the plow portion, the second wing including a second plow face operable to direct snow, the second plow face including a second lower portion and a second upper portion; and a second window coupled to the second upper portion of the second plow face, the second window being transmissive to light output from the vehicle.

11. The snow plow of claim 1 wherein the plow support is operable to removably connect to a vehicle-side mount of a vehicle support.

12. The snow plow of claim 11 wherein the vehicle-side mount is disposed proximal to a front of the vehicle.

13. The snow plow of claim 1 wherein the blade is attached to the plow portion.

14. The snow plow of claim 1 comprising an actuator operable to raise and lower the plow portion.

15. The snow plow of claim 14 wherein the actuator is operable to bias the plow portion into contact with the ground surface.

16. A snow plow system for a vehicle, the snow plow system comprising:

a plow including a main plow with a first side and a second side opposite each other with a blade disposed between the first and second sides, the blade operable to contact a ground surface to facilitate moving snow;

a first wing that is rotatably coupled to the first side of the main plow via a first connection, the first wing being configured to rotate about a first axis substantially parallel to the first side of the main plow, the first wing being raisable off the ground for transport;

a first window coupled to an upper portion of the first wing, the first window being transmissive to light output from the vehicle, the first window providing an operable surface for moving snow;

a second wing that is rotatably coupled to the second side of the main plow via a second connection, the second wing being configured to rotate about a second axis substantially parallel to the second side of the main plow;

a second window coupled to an upper portion of the second wing, the second window being transmissive to light output from the vehicle, the second window providing an operable surface for moving snow; and wherein, with the first wing rotated toward a side of the vehicle and raised off the ground for transport, the first window coupled to the first wing provides transmissibility for light that is output from the vehicle head lamp and that is directed transverse with respect to a longitudinal axis of the vehicle.

17. The snow plow system of claim 16 wherein the first wing includes a first plow face operable to direct snow, and wherein the first plow face includes a first window support frame that defines a first aperture and supports the first window.

18. The snow plow system of claim 16 wherein the second wing includes a second plow face operable to direct snow, and wherein the second plow face includes a second window support frame that defines a second aperture and supports the second window.

19. The snow plow system of claim 18 wherein the first wing operable to rotate about the first axis between a backward position and a forward position, and where the first wing is rotatable to an intermediate position between the backward position and the forward position.

20. The snow plow system of claim 19 wherein:

the intermediate position corresponds to a first wing plow face being substantially transverse with respect to a longitudinal axis of the vehicle, the first wing plow face extends outward relative to a plane defined by a side of the vehicle; and the first window provides transmissibility for light generated from the vehicle and traveling outward relative to the plane defined by the side of the vehicle.

21. The snow plow system of claim 17 comprising a receiver coupled to one of the vehicle or the main plow, the receiver defining an opening for a receiver interface, the receiver interface being movably within the receiver along a longitudinal axis of the receiver;

the receiver interface being coupled to the other of the vehicle or the main plow that is connected to the receiver; and at least one actuator operable to move the receiver interface along the longitudinal axis of the receiver, the actuator operable to move the main plow proximally and distally with respect to the vehicle as the at least one actuator moves the receiver interface along the longitudinal axis.

* * * * *